US012708240B2

(12) United States Patent
Reis

(10) Patent No.: US 12,708,240 B2
(45) Date of Patent: Aug. 18, 2026

(54) SAFETY MAT

(71) Applicant: Adriana Reis, Cape Coral, FL (US)

(72) Inventor: Adriana Reis, Cape Coral, FL (US)

( * ) Notice: Subject to any disclaimer, the term of this patent is extended or adjusted under 35 U.S.C. 154(b) by 108 days.

(21) Appl. No.: 18/733,990

(22) Filed: Jun. 5, 2024

(65) Prior Publication Data

US 2025/0375065 A1 Dec. 11, 2025

Related U.S. Application Data

(60) Provisional application No. 63/506,394, filed on Jun. 6, 2023.

(51) Int. Cl.
*A47K 3/00* (2006.01)

(52) U.S. Cl.
CPC ..... *A47K 3/002* (2013.01)

(58) Field of Classification Search
CPC ..... A47K 3/002
USPC ..... 4/582, 581
See application file for complete search history.

(56) References Cited

U.S. PATENT DOCUMENTS 2,217,821 A * 10/1940 Shiner ..... A47K 3/002 4/577.1
3,408,663 A * 11/1968 Bunting ..... A47G 27/0225 4/581
4,122,846 A * 10/1978 Baumann ..... A47K 3/001 4/581
4,167,599 A * 9/1979 Nissinen ..... E01C 13/045 4/581
4,328,275 A * 5/1982 Vargo ..... B32B 3/28 4/581
4,644,592 A * 2/1987 Small ..... A47K 3/002 428/40.1
5,173,346 A * 12/1992 Middleton ..... B32B 5/18 4/581
5,375,271 A * 12/1994 Frankel ..... A47K 3/002 4/581
5,776,605 A * 7/1998 May ..... B32B 7/12 4/582

(Continued)

FOREIGN PATENT DOCUMENTS

CN 109199178 A * 1/2019 ..... A47K 3/02
DE 112011100254 T5 * 7/2013 ..... C08J 7/0427

(Continued)

*Primary Examiner* — Lori L Baker
(74) *Attorney, Agent, or Firm* — Joel Douglas; Thomas Ciesco

(57) ABSTRACT

A safety mat includes a base layer having a lower surface and an upper surface, an adhesive layer disposed on the lower surface of the base layer and a release liner attached to the adhesive layer. The release liner is configured for removal to expose the adhesive layer for adhering the safety mat to a surface. The safety mat includes a graphics layer disposed on the upper surface of the base layer may include a design. The safety mat includes a second adhesive layer disposed between the base layer and the graphics layer, the second adhesive layer configured to allow the graphics layer to be changeable. The base layer is textured to prevent a user from slipping on the safety mat. The safety mat may include a temporary adhesive layer disposed between the base layer and the graphics layer to allow the graphics layer to be changeable.

20 Claims, 4 Drawing Sheets

(56) References Cited

U.S. PATENT DOCUMENTS

| | | | | | |
|---|---|---|---|---|---|
| 5,781,941 | A * | 7/1998 | Radke | A47K 3/002 | 428/327 |
| 6,114,002 | A * | 9/2000 | Rinaldo | A47G 27/0225 | 428/44 |
| 6,353,943 | B1 * | 3/2002 | Stevens | A47K 3/002 | 4/582 |
| 7,152,256 | B1 * | 12/2006 | Roberts | A47K 3/002 | 4/581 |
| 7,665,159 | B2 * | 2/2010 | Fowkes | A47K 3/12 | 4/581 |
| 8,021,733 | B2 * | 9/2011 | Carter-Patterson | B32B 5/06 | 428/80 |
| 9,028,717 | B2 * | 5/2015 | Nagel | C09K 11/7713 | 252/301.4 R |
| 9,784,415 | B2 * | 10/2017 | Linge | F21K 2/00 | |
| 10,285,543 | B1 * | 5/2019 | Hall | A47K 3/281 | |
| 10,639,073 | B1 * | 5/2020 | Serna | A61B 17/54 | |
| 11,453,195 | B2 * | 9/2022 | Bing | B32B 3/30 | |
| 2006/0207011 | A1 * | 9/2006 | Meyers | A47K 3/002 | 4/583 |
| 2007/0044261 | A1 * | 3/2007 | Bolton | A47K 3/002 | 4/606 |
| 2007/0050905 | A1 * | 3/2007 | Fowkes | A47K 3/12 | 4/579 |
| 2007/0128429 | A1 * | 6/2007 | Murphy | B32B 25/04 | 428/319.3 |
| 2008/0216228 | A1 * | 9/2008 | Bonanno | A47K 3/002 | 4/583 |
| 2009/0048417 | A1 * | 2/2009 | Berrigan | A47K 3/002 | 528/44 |
| 2010/0081002 | A1 * | 4/2010 | Carter-Patterson | B32B 25/10 | 428/474.4 |
| 2013/0326805 | A1 * | 12/2013 | Skrzyniarz | A47K 3/002 | 4/572.1 |
| 2016/0037949 | A1 * | 2/2016 | Dawson | B32B 7/06 | 428/95 |
| 2016/0290625 | A1 * | 10/2016 | Tomkiewicz | A47K 3/002 | |
| 2017/0037568 | A1 * | 2/2017 | Love | A47L 23/266 | |
| 2018/0055266 | A1 * | 3/2018 | Puthillath | A47G 27/0206 | |
| 2021/0079585 | A1 * | 3/2021 | Herny | D06F 57/12 | |
| 2022/0042235 | A1 * | 2/2022 | Herny | A47K 3/002 | |
| 2024/0065489 | A1 * | 2/2024 | Chen | B32B 5/275 | |

FOREIGN PATENT DOCUMENTS

| | | | | | |
|---|---|---|---|---|---|
| GB | 2108838 | A | * | 5/1983 | A47K 3/002 |
| GB | 2154447 | A | * | 9/1985 | A47K 3/002 |
| GB | 2268399 | A | * | 1/1994 | A47L 23/266 |
| JP | 2003180506 | A | * | 7/2003 | A47K 3/02 |
| KR | 20030048098 | A | * | 6/2003 | A47L 23/22 |
| KR | 20170003818 | U | * | 11/2017 | A47G 27/0281 |
| KR | 20170139889 | A | * | 12/2017 | C08L 23/0853 |
| KR | 20220023499 | A | * | 3/2022 | A47G 27/0212 |
| TW | I523627 | B | * | 3/2016 | A47K 3/02 |
| TW | 201637865 | A | * | 11/2016 | B32B 7/02 |
| WO | WO-03106747 | A2 | * | 12/2003 | A47L 23/266 |
| WO | WO-2009009483 | A1 | * | 1/2009 | G02B 6/0003 |
| WO | WO-2016144851 | A1 | * | 9/2016 | B32B 7/02 |
| WO | WO-2017172360 | A1 | * | 10/2017 | D06N 7/0094 |
| WO | WO-2018038779 | A1 | * | 3/2018 | D06N 7/0094 |

* cited by examiner

SAFETY MAT

CROSS-REFERENCE TO RELATED APPLICATIONS

This application is a Utility Patent application claiming priority to U.S. Provisional Patent Application Ser. No. 63/506,394, filed on Jun. 6, 2023, which is incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks used in the disclosure of the invention, and the applicants make no claim to any trademarks referenced.

BACKGROUND OF THE INVENTION

Field of the Invention

The invention relates to a safety mat for use in a variety of floors or other surfaces such as a bathroom floor, kitchen floor, bathtub, or shower stall, and more particularly, to a safety mat having an adhesive for installing on a surface or on the floor.

Description of Related Art

Currently the state of the art includes various non-slip mats. It is well known that bathtubs and shower stalls are slippery and present a great risk of injury to users standing therein, and entering or leaving the bathtub or shower stall, especially in the presence of water and soap. This is because bathtubs and shower stalls are generally made of materials, such as acrylic, cast-iron porcelain, steel, and polymer, etc., that do not have a high coefficient of friction with human skin. In attempts to compensate for this problem, various safety mats or safety strips are available which provide an increased resistance to slipping while standing in the bathtub or shower stall, and thus minimize the risk of slippage of a person standing thereon.

It is also known in the art to use foot massage mats which include a multiplicity of conical protrusions having rounded apexes in order to massage a user's feet, thereby stimulating the feet, and enhancing blood circulation of the user. A top laminated area of the base layer or the graphics layer includes a glass bead surface for a pleasing tactile experience underfoot. Walking on a textured surface like sand or glass beads offers significant health advantages, including improved circulation from stimulating nerves and blood vessels, providing a natural foot massage. This texture enhances balance and proprioception, strengthens foot and lower leg muscles, and reduces foot pain and swelling, supporting overall ergonomic well-being. The textures integrated into the safety mat not only boosts comfort but also promotes better posture and reduces strain on the lower back and joints, ensuring a healthier and more comfortable standing experience.

People using a bathtub or shower stall, particularly elderly and handicapped people, sometimes require seating aids to be placed in bathtubs or shower stalls, which help to prevent the inherent risks and difficulties involved in positioning themselves on the floor of a bathtub or shower stall by permitting the user to be seated at a relatively higher position than if they were seated on the floor of the bathtub or shower stall or on a safety mat placed therein. However, the floor of bathtubs and shower stalls, particularly in the presence of water and soap is also very slippery to a seating aid such as a bath or shower bench having its legs supported on the floor of a bathtub and shower stall, and thereby presents the risk of the user slipping and falling while sitting on such a seating aid during a bath or shower.

It is also undesirable to have the seating aids stand on the bath or shower mats directly, due to the stability concern. When a seating aid stands directly on a bath or shower mat, pressing forces are unevenly applied to the mat, which compromises the stable attachment of the mat on a wet and soapy floor of a bathtub or shower stall, particularly in instances of mats having a limited number of suction cups on the bottom surface thereof.

Another area where mats are frequently used is in the area of sitting mats for children. These mats usually have printed graphics such as the alphabet, numbers, different colored fruit and boxes and circles for the child to add information to the mat with erasable writing devices.

Conventional bath or shower mats present other disadvantages. For example, the thin layer construction of conventional bath or shower mats does not allow frequent machine washing and thus mildew and bacteria may grow on these mats over time.

Therefore, there is a need for a safety apparatus overcoming the disadvantages of the conventional mat in order to provide comfortable and safe conditions for users during a bath or shower.

SUMMARY OF THE INVENTION

In the first implementation of the invention is a safety mat that provides comfortable and safe conditions. The safety mat is a non-slip, mold-resistant adhesive mat with fun and colorful designs, enhance safety, cleanliness, and aesthetic appeal for use in various areas.

The instant invention is an innovative solution designed to address the prevalent problem of slips and falls in various areas, particularly in wet and slippery environments like bathtubs, showers, and other wet surfaces. This invention aims to prevent accidents and injuries due to loss of traction by providing a non-slip surface that enhances grip and stability. By offering a secure footing and reducing the risk of falls, the instant invention promotes safety and peace of mind for individuals of all ages. This invention is a practical and effective means to prevent slip-related incidents, ultimately improving users' well-being and quality of life in their everyday activities.

The safety mat includes a base layer having a lower surface and an upper surface, an adhesive layer disposed on the lower surface of the base layer and a release liner attached to the adhesive layer. The release liner is configured for removal to expose the adhesive layer for adhering the safety mat to a surface. The safety mat includes a graphics layer disposed on the upper surface of the base layer may include a design. The safety mat includes a second adhesive layer disposed between the base layer and the graphics layer, the second adhesive layer configured to allow the graphics layer to be changeable. The base layer is textured to prevent a user from slipping on the safety mat. The safety mat may include a temporary adhesive layer disposed between the base layer and the graphics layer to allow the graphics layer to be changeable.

The instant invention revolutionizes how users stay safe and embrace a world where safety is practical and visually captivating because when it comes to keeping ourselves protected, we believe it should be anything but boring.

BRIEF DESCRIPTION OF DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF THE INVENTION

Figure 1:
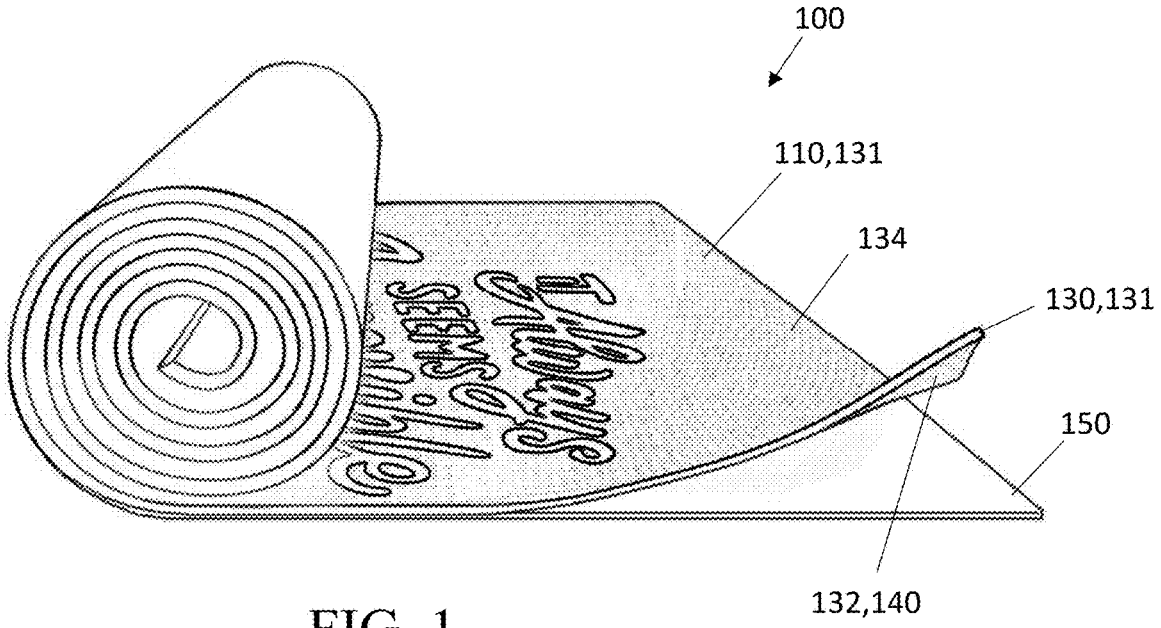
FIG. 1 is side perspective view of a partially unrolled safety mat according to the present invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art however that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components including one unit and elements and components that include more than one unit, unless specifically stated otherwise.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps, or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms floor, tub, shower are used interchangeably to mean a surface that is designed for a person to stand or walk on.

The instant invention revolutionizes how we stay safe and embrace a world where safety is practical and visually captivating because when it comes to keeping ourselves protected, we believe it should be anything but boring.

The instant invention is an innovative solution designed to address the prevalent problem of slips and falls in various areas, particularly in wet and slippery environments like bathtubs, showers, and other wet surfaces. This invention aims to prevent accidents and injuries due to loss of traction by providing a non-slip surface that enhances grip and stability. By offering a secure footing and reducing the risk of falls, The instant invention promotes safety and peace of mind for individuals of all ages. This invention is a practical and effective means to prevent slip-related incidents, ultimately improving users' well-being and quality of life in their everyday activities.

In a world where vibrant colors, playful designs, and captivating patterns take center stage in protecting our loved ones, the safety mat includes features to focus on mental and physical health of people of all ages. The instant invention is designed to promote safety for all flooring, walking, or standing surfaces. The innovative approach used in the design of the instant invention shatters the existing notion that preventing accidents must be boring. The non-slip solutions of the instant invention combine functionality with captivating aesthetics, making safety an enjoyable and visually stimulating experience. The instant invention allows users to step into a world where every precautionary measure is an opportunity for self-expression and creativity.

A top laminated area of the base layer or the graphics layer includes a glass bead surface for a pleasing tactile experience underfoot. Walking on a textured surface like sand or glass beads offers significant health advantages, including improved circulation from stimulating nerves and blood vessels, providing a natural foot massage. This texture enhances balance and proprioception, strengthens foot and lower leg muscles, and reduces foot pain and swelling, supporting overall ergonomic well-being. The textures integrated into the safety mat not only boosts comfort but also promotes better posture and reduces strain on the lower back and joints, ensuring a healthier and more comfortable standing experience.

The non-slip adhesive mats of the instant invention are safe for children, teens, and adults. The instant invention has a peel-and-stick backing for easy installation and removal.

The instant invention can be printed with fun and colorful designs complimenting popular themes and color schemes. Users can select from predesigned themes, personalize their bathmats with names and designs, upload photos, or request custom design options from a verified designer.

The instant invention provides a comprehensive solution for customers. In addition to offering high-quality non-slip adhesive mats, we also provide professional installation services through our team of experts. We understand that specific spaces, such as large areas or rooms with high foot traffic, require meticulous installation to ensure optimal safety and performance.

The instant invention will be customized by using a team of experienced experts who are trained in the proper application of the instant invention. The customization will focus on the unique requirements of different environments where the instant invention can be deployed and the focus of matching the mat to the environment.

Whether it's a commercial establishment, a healthcare facility, or a public space, the instant invention installation services ensure a professional and secure application.

By availing ourselves of our large-scale installation services, our partners and customers can have peace of mind knowing that knowledgeable professionals are implementing safety measures. Our experts will assess the area, determine the best placement for the mats, and install them efficiently and effectively, saving time and effort and ensuring that the mats are correctly positioned for maximum effectiveness in preventing slips and falls. In areas with significant foot traffic, safety should be a top priority. Our installation services offer a hassle-free solution, allowing us to enhance safety in large areas or rooms with the expertise and precision of our team.

The instant invention is available to the end consumer in standard and customizable sizes for bathtubs and walk-in showers with and without drain cutouts and standard mat sizes for bathroom floors, laundry rooms, kitchen floors, pool, and wet areas.

The power of collaboration and the value of combining our expertise in safety with the design process of popular home and outdoor decor brands. That's why we are eager to partner with renowned home and outdoor decor brands to create co-branded non-slip mats.

By joining forces with established home decor brands, we can leverage their unique design aesthetics, extensive customer base, and brand recognition to enhance the appeal of our non-slip mats. This collaboration allows us to infuse our safety-focused product with the style, trends, and visual appeal that customers already associate with these respected brands.

Through co-branded efforts, we can offer a broader range of design options that cater to diverse tastes and complement various interior styles. Whether it's collaborating on patterns, colors, or thematic collections, the synergy between The instant invention and home decor brands will result in non-slip mats that seamlessly blend safety and style.

Furthermore, partnering with popular home decor brands allows us to reach a broader audience and tap into their existing customer base. By integrating our non-slip mats into their product offerings or marketing campaigns, we can introduce our safety solution to a broader market and raise awareness about the importance of slip prevention in homes and various environments.

Ultimately, we aim to create co-branded non-slip mats that prioritize safety and reflect our partners' design excellence and brand identity. By combining forces, we can provide customers with innovative and visually appealing safety solutions that seamlessly integrate into their homes and spaces, making safety a stylish and integral part of their overall decor.

The most recent studies conducted by the CDC and CPSC uncovered alarming statistics concerning injuries in the bathroom, emphasizing the urgent need for improved safety measures.

Approximately 370 individuals are injured in a bathroom daily in the U.S., making it the second most dangerous room in the house, bested only by the kitchen.

In addition, 66% of injuries that take place in bathrooms occur when people are either in the tub or the shower.

The most common of these injuries stem from "slips and falls" while showering or bathing; they account for more than one-third, about 78,000, of all bathroom injuries in the United States.

Every year, approximately 235,000 adults and teenagers over 15 are admitted to emergency rooms in the U.S. due to these "slips and falls."

Children under five account for almost 30 percent of the annual bathtub and shower-related accidents. Over 75 percent of all bathtub and shower-related fatalities occur among children under five. The most frequent type of accident was found to be slipping and falling in bathtubs and showers.

The non-slip, mold-resistant adhesive mats of the instant invention have fun and colorful designs build upon existing bathtub mats, non-skid strips, and non-slip stickers to create slip-resistant standing surfaces that offer superior traction, are resistant to mold, mildew, and odors, and feature innovative design elements that people will love to include in their homes to enhance safety.

The present disclosure provides a safety mat designed to enhance safety in various environments by providing a non-slip surface. The safety mat may comprise a base layer, an adhesive layer, a graphics layer, and a release liner. The base layer, which may be textured, serves as the primary structure of the safety mat and may be made from various materials such as rubber or foam to enhance its properties such as grip, comfort, and durability. The adhesive layer, disposed on the lower surface of the base layer, may be designed to adhere the safety mat to a variety of surfaces. The graphics layer, disposed on the upper surface of the base layer, may feature a variety of designs to suit different tastes or requirements. A second adhesive layer may be disposed between the base layer and the graphics layer, allowing the graphics layer to be changeable. The release liner, attached to the adhesive layer, may be configured for removal to expose the adhesive layer for adhering the safety mat to a surface. The safety mat may be used in a variety of settings, including but not limited to, hospitals, outdoor recreational settings, industrial workplaces, educational institutions, and retail and commercial spaces. The safety mat may be used on stairs, elevator floors, malls, arenas or along with the other high-traffic areas. In some cases, the safety mat may be part of a kit that includes a first safety mat for use in a specific area and a matching second mat for use in a second area. The safety mat may be designed to be non-slip and mold-resistant, enhancing safety and cleanliness in various areas.

In some aspects, the safety mat may be part of a kit that includes a first safety mat and a matching second safety mat. Both the first and second safety mats may include a base layer, an adhesive layer, a graphics layer, and a release liner. The base layer may have a lower surface and an upper surface. The adhesive layer may be disposed on the lower surface of the base layer, allowing the safety mat to adhere to a variety of surfaces. The graphics layer may be disposed on the upper surface of the base layer, featuring a variety of designs to suit different tastes or requirements. A second adhesive layer may be disposed between the base layer and the graphics layer, allowing the graphics layer to be changeable. The release liner, attached to the adhesive layer, may be configured for removal to expose the adhesive layer for adhering the safety mat to a surface.

In some cases, the first safety mat and the second safety mat may have matching designs on their respective graphics layers. This may allow for a coordinated aesthetic across different areas where the safety mats are used. For instance, the first safety mat may be used in a shower stall, bathtub, or bathroom floor, while the matching second mat may be used in a second area such as a hallway or kitchen. The matching designs on the graphics layers of the first and second safety mats may enhance the visual appeal of the areas where they are used.

In some aspects, the second safety mat may have an adhesive layer, similar to the first safety mat. This may allow the second safety mat to be securely adhered to a surface, similar to the first safety mat. In other cases, the second safety mat may be provided without the adhesive layer. This may allow the second safety mat to be used in areas where permanent adhesion is not desired or practical. For instance, the second safety mat may be used as a temporary or movable mat in areas where the surface conditions or usage requirements frequently change.

In some aspects, the adhesive layer of the safety mat may be made from different types of adhesive to suit different surfaces or conditions. For instance, the adhesive layer may be made from a stronger adhesive for surfaces that are difficult to stick to, or from a weaker adhesive for surfaces that are easily damaged. In some cases, the adhesive layer may be made to be removable or repositionable, allowing the safety mat to be moved or adjusted after installation. This flexibility in the adhesive layer may provide users with the convenience of being able to relocate the safety mat as desired or as conditions require.

In some embodiments, the adhesive layer may be configured to allow the safety mat to be rolled into a temporary rolled position before installation. This feature may facilitate the transportation and storage of the safety mat prior to its use. It may also make the installation process easier, as the user can simply unroll the safety mat onto the desired surface. Once the release liner is removed, the adhesive layer may securely adhere the safety mat to the surface, providing a non-slip area for users.

In some aspects, the safety mat may be made in different sizes and shapes to fit different areas or uses. For instance, the safety mat may be made larger for use in a shower stall, or smaller for use on a bathroom floor. The size and shape of the safety mat may be selected based on the specific requirements of the area where it is to be installed. This flexibility in size and shape may allow the safety mat to be used in a wide variety of settings, from small residential bathrooms to large industrial workplaces.

In some cases, the safety mat may be made in different shapes, such as rectangular, circular, or irregular, to fit different spaces or to create different visual effects. For instance, a rectangular safety mat may be suitable for a long hallway, while a circular safety mat may be ideal for a round shower stall. An irregularly shaped safety mat may be used to fit a uniquely shaped area or to create a visually interesting effect.

The shape of the safety mat may be selected based on the specific requirements of the area where it is to be installed, the aesthetic preferences of the user, or other factors.

In some aspects, the base layer of the safety mat may be textured to prevent a user from slipping on the safety mat. The texture of the base layer may provide additional grip, enhancing the safety of the mat. The texture may be made coarser or finer, or it could be made with different patterns such as ridges, grooves, or bumps. The texture could also be varied to create different visual effects, such as a 3D effect or a holographic effect.

In some cases, the texture of the base layer may include dimples or a sand texture. Dimples may provide a tactile surface that enhances grip, while a sand texture may provide a rough surface that prevents slipping. The specific texture used may depend on the specific requirements of the area where the safety mat is to be installed, the preferences of the user, or other factors.

In some aspects, the safety mat may find application in various settings such as hospitals, outdoor recreational settings, industrial workplaces, educational institutions, and retail and commercial spaces.

In the context of hospitals and other healthcare facilities, the safety mat may serve to prevent slips and falls. The changeable graphics layer may be utilized to display safety messages or instructions, or to provide visual cues for patients with cognitive impairments. The adhesive layer may allow the mat to be securely attached to the floor, while the textured base layer may provide a non-slip surface. The mat may be made from materials that are easy to clean and disinfect, making it suitable for use in a healthcare setting.

For outdoor recreational settings such as playgrounds, swimming pools, or camping sites, the safety mat may provide a non-slip surface in wet or slippery conditions, enhancing safety for users. The changeable graphics layer may be used to display fun or educational designs, or to blend in with the natural environment. The mat may be made from durable materials that can withstand outdoor conditions, and the adhesive layer may be designed to stick to a variety of surfaces.

In industrial workplaces such as factories, warehouses, or construction sites, the safety mat may provide a non-slip surface in areas where spills or leaks may occur, reducing the risk of workplace accidents. The changeable graphics layer may be used to display safety messages or instructions, or to mark out designated areas. The mat may be made from durable materials that can withstand heavy use, and the adhesive layer may be designed to stick to a variety of surfaces.

In educational institutions such as schools, colleges, or libraries, the safety mat may provide a non-slip surface in areas where spills may occur, such as cafeterias or science labs. The changeable graphics layer may be used to display educational designs or messages, or to mark out designated areas. The mat may be made from materials that are easy to clean and maintain, and the adhesive layer may be designed to stick to a variety of surfaces.

In retail and commercial spaces such as shops, restaurants, or offices, the safety mat may provide a non-slip surface in areas where spills may occur, enhancing safety for customers and employees. The changeable graphics layer may be used to display promotional designs or messages, or to blend in with the interior decor. The mat may be made from materials that are easy to clean and maintain, and the adhesive layer may be designed to stick to a variety of surfaces.

In some aspects, the safety mat may be part of a kit. This kit may include a first safety mat and a matching second mat. The first safety mat may be designed for use in specific areas such as a shower stall, bathtub, or bathroom floor. The second mat, which matches the first, may be intended for use in a second area. This second area could be any location where a non-slip surface may be beneficial, such as a kitchen, hallway, or outdoor patio.

The matching second mat may be identical to the first safety mat in terms of design and material composition. Alternatively, the second mat may differ in some aspects, such as size, shape, or graphics, while still matching the first mat in terms of overall aesthetic or theme. For instance, the second mat may be smaller or larger than the first mat, or it may have a different shape to fit a different space. The graphics on the second mat may also be different, but still related to the graphics on the first mat. For example, if the first mat features a design of tropical fruits, the second mat may feature a design of tropical flowers.

In some cases, the second mat may have an adhesive layer, similar to the first mat, allowing it to be securely attached to a surface. In other cases, the second mat may be provided without an adhesive layer. This could be beneficial in situations where the second mat is intended for use on a surface that is not suitable for adhesive attachment, or where the user prefers to have the flexibility to move the mat around without having to remove and reapply an adhesive layer.

The inclusion of a second mat in the kit provides the user with more options and flexibility. For instance, the user may choose to use the first mat in a shower stall and the second mat on a bathroom floor, creating a coordinated look. Alternatively, the user may choose to use the first mat in a bathroom and the second mat in a kitchen, spreading the safety and aesthetic benefits of the safety mat to multiple areas of the home. The user may also choose to switch between the first and second mats in a single location, depending on their mood, the season, or other factors.

In some aspects, the base layer of the safety mat may be textured. This texture may serve to prevent a user from slipping on the safety mat, enhancing the safety function of the mat. The texture of the base layer may vary in different embodiments. For instance, the texture may include dimples, a sand texture, or other types of texture that can provide a non-slip surface. The texture may be formed directly on the base layer, or it may be formed on a separate layer that is attached to the base layer. The texture may cover the whole surface of the base layer, or it may be localized to specific areas. The texture may also vary in depth, density, or other characteristics, depending on the specific requirements or preferences.

In some cases, the safety mat may be designed to be non-slip and mold-resistant. The non-slip property may be achieved through the texture of the base layer, the material composition of the base layer, or other design features. The mold-resistance property may be achieved through the use of mold-resistant materials, a special coating, or other means. The non-slip and mold-resistant properties of the safety mat may enhance its safety and cleanliness, making it suitable for use in various areas such as bathrooms, kitchens, outdoor patios, and other areas where there may be a risk of slipping or mold growth.

In some aspects, the safety mat may be designed to be non-slip. This non-slip property may be achieved through various design features. For instance, the base layer of the safety mat may be textured. The texture of the base layer may include dimples, which can provide a non-slip surface. The dimples may be formed directly on the base layer, or they may be formed on a separate layer that is attached to the base layer. The dimples may cover the whole surface of the base layer, or they may be localized to specific areas. The size, shape, and density of the dimples may vary, depending on the specific requirements or preferences.

In some cases, the safety mat may also be designed to be mold-resistant. This mold-resistance property may be achieved through the use of mold-resistant materials in the construction of the safety mat, a special coating applied to the surface of the mat, or other means. The mold-resistant property of the safety mat may enhance its cleanliness, making it suitable for use in various areas such as bathrooms, kitchens, outdoor patios, and other areas where there may be a risk of mold growth.

In some embodiments, the safety mat may be both non-slip and mold-resistant. This combination of properties may enhance the safety and cleanliness of the safety mat, making it suitable for use in a wide range of environments and applications.

The safety mat may be photoluminescent, which provides additional safety in areas like bathrooms, kitchens, hospitals, etc. The base layer may include a photoluminescent material integrated with the base layer or applied to the base layer after manufacture of the base layer. The graphic layer is then place on top of the base layer where at least a portion of the base layer would be visible outside of the graphics area, within the graphics area between graphic features, or through the graphics area if the graphics are transparent of semi-transparent. Alternately, the graphics layer may be photoluminescent and may be additionally enclosed in the kit, wither as a permanent graphic or a changeable graphic.

Referring now to FIG. 1, a partially unrolled safety mat 100 includes a base layer 130 having a lower surface 132 and an upper surface 134, an adhesive layer 140 disposed on the lower surface 132 of the base layer 130. The safety mat 100 includes a release liner 150 attached to the adhesive layer 140 before removal of the release liner 150 from the base layer 130. The release liner 150 is configured for removal to expose the adhesive layer 140 for adhering the safety mat 100 to a surface. The safety mat 100 includes a graphics layer 110 disposed on the upper surface 134 of the base layer 130. The graphics layer 110 may include an artistic design, message, lettering or the like. The base layer 130 is textured to prevent a user from slipping on the safety mat. Alternately, the graphics layer 110 may be textured rather than the base layer 130. In another alternate graphics layer, the graphics may be screened or painted media which is self-adhering and does not require an adhesive layer. The safety mat provides additional safety in areas like bathrooms, kitchens, hospitals, etc., and may be used on stairs, elevator floors, malls, arenas or along with the other high-traffic areas.

Figure 2:
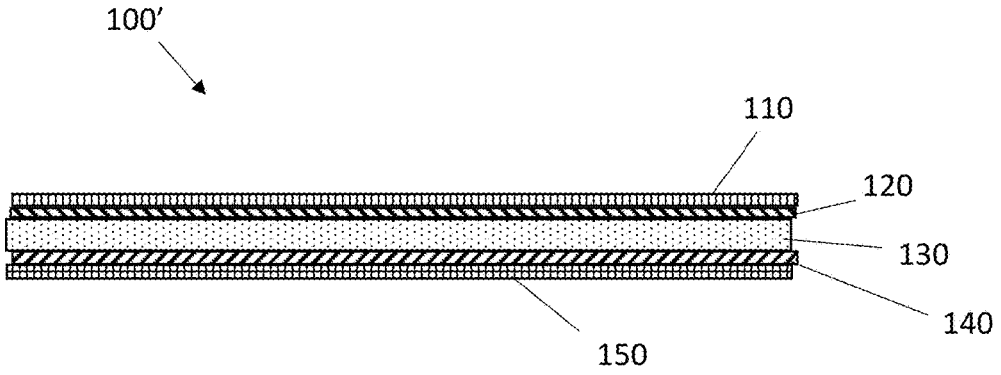
FIG. 2 is a side perspective view of a portion of the safety mat showing the layers of the safety mat.

Referring now to FIG. 2 showing another embodiment of the invention, a safety mat 100 includes a base layer 130 having a lower surface 132 and an upper surface 134, an adhesive layer 140 disposed on the lower surface 132 of the base layer 130. The safety mat 100 includes a release liner 150 attached to the adhesive layer 140 before removal of the release liner 150 from the base layer 130. The release liner 150 is configured for removal to expose the adhesive layer 140 for adhering the safety mat 100 to a surface. The safety mat 100 includes a graphics layer 110 disposed on the upper surface 134 of the base layer 130. The graphics layer 110 may include an artistic design, message, lettering or the like. The safety mat 100 includes a second adhesive layer 120 disposed between the base layer and the graphics layer, the second adhesive layer 120 configured to allow the graphics layer to be changeable. The base layer 130 is textured to prevent a user from slipping on the safety mat. Alternately, the graphics layer 110 may be textured rather than the base layer 130. In another alternate graphics layer, the graphics may be screened or painted media which is self-adhering and does not require an adhesive layer.

Figure 3:
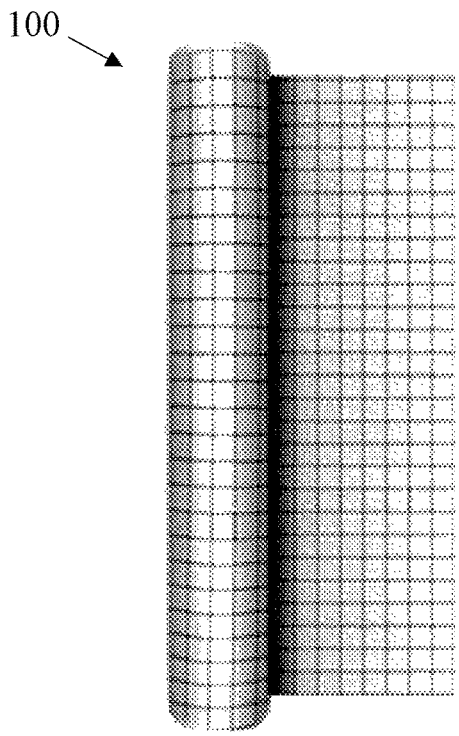
FIG. 3 a top perspective view of the partially unrolled safety mat shown in FIG. 1.
Figure 4:
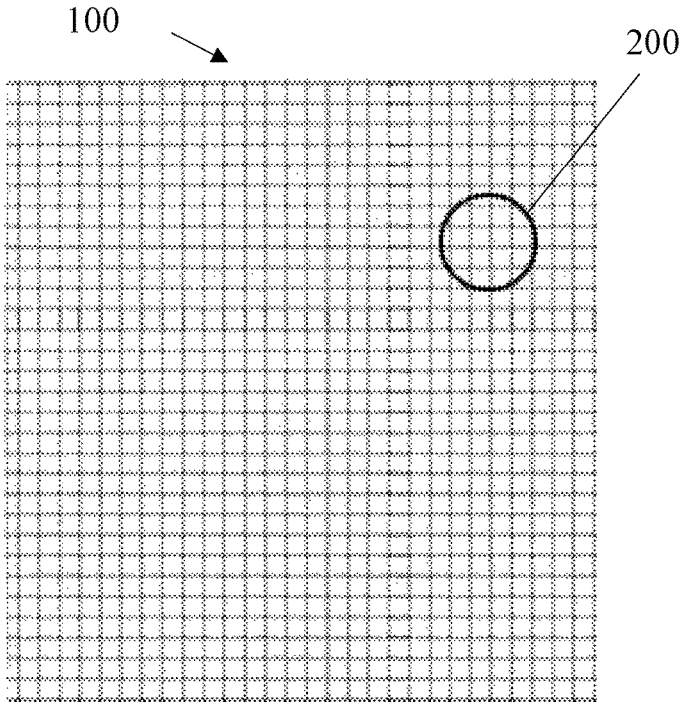
FIG. 4 a top plan view of the unrolled safety mat shown in FIG. 1 with a portion circled for the enlarged view in FIG. 5.
Figure 5:
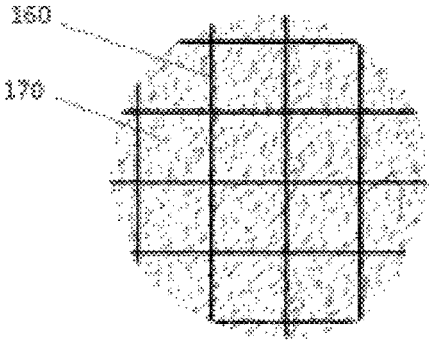
FIG. 5 is a top plan view of portion A shown in FIG. 4.
Figure 6:
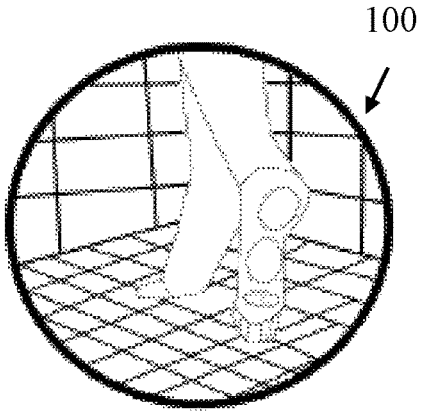
FIG. 6 shows a safety mat installed in a shower for preventing slippage of a user.

FIG. 3 is a partially rolled top perspective view of the safety mat and FIG. 4 a top plan view of the unrolled safety mat with the circled portion 200 shown in an enlarged view in FIG. 5. FIG. 6 shows a safety mat installed in a shower for preventing slippage of a user.

Figure 7A:
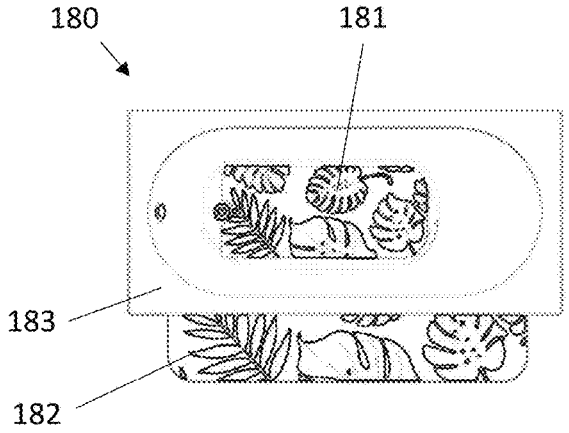
FIG. 7A is a top plan view of one kit installed in a tub and on the floor next to the tub.

FIG. 7A is a top plan view of one example kit 180 installed in a tub 183 and on the floor next to the tub. The kit includes a first safety mat 181 and a second safety mat 182 with the same graphical design.

Figure 7B:
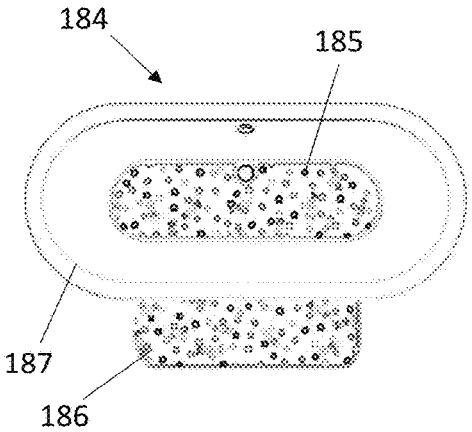
FIG. 7B is a top plan view of another kit installed in a tub and on the floor next to the tub.

FIG. 7B is a top plan view of another example kit 184 installed in a tub 187 and on the floor next to the tub. The kit includes a first safety mat 185 and a second safety mat 186 with the same graphical design.

Figure 7C:
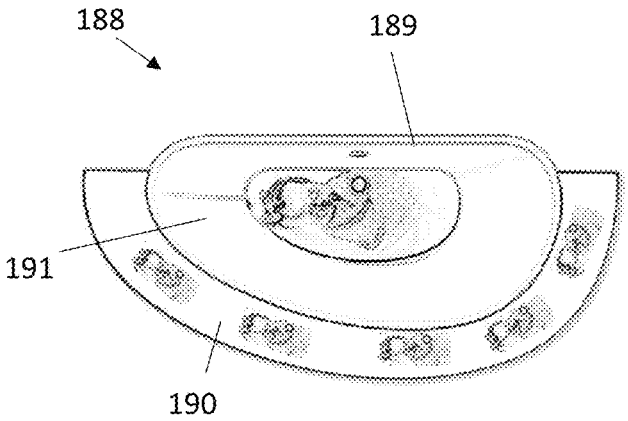
FIG. 7C is a top plan view of another kit installed in a tub and on the floor next to the tub.

FIG. 7C is a top plan view of another example kit 188 installed in a tub 191 and on the floor next to the tub. The kit includes a first safety mat 189 and a second safety mat 190 with the same graphical design.

Figure 7D:
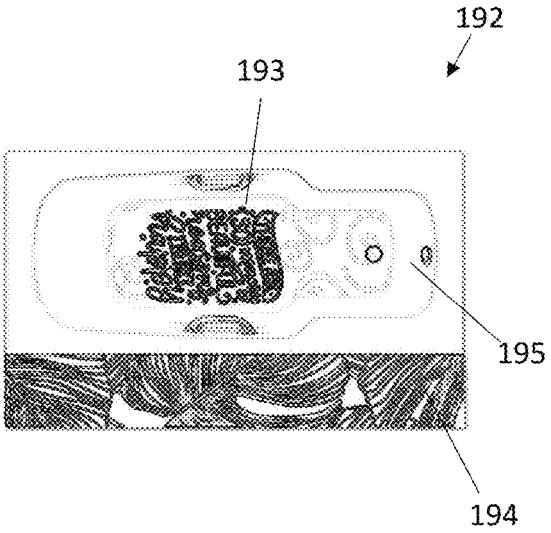
FIG. 7D is a top plan view of another kit installed in a tub and on the floor next to the tub.

FIG. 7D is a top plan view of another example kit 192 installed in a tub 183 and on the floor next to the tub. The kit includes a first safety mat 195 in the tub and a second safety mat 194 with the same graphical design on the floor. The second safety mat 194 is specifically shaped to fit the contour of the tub 183.

Figure 8:
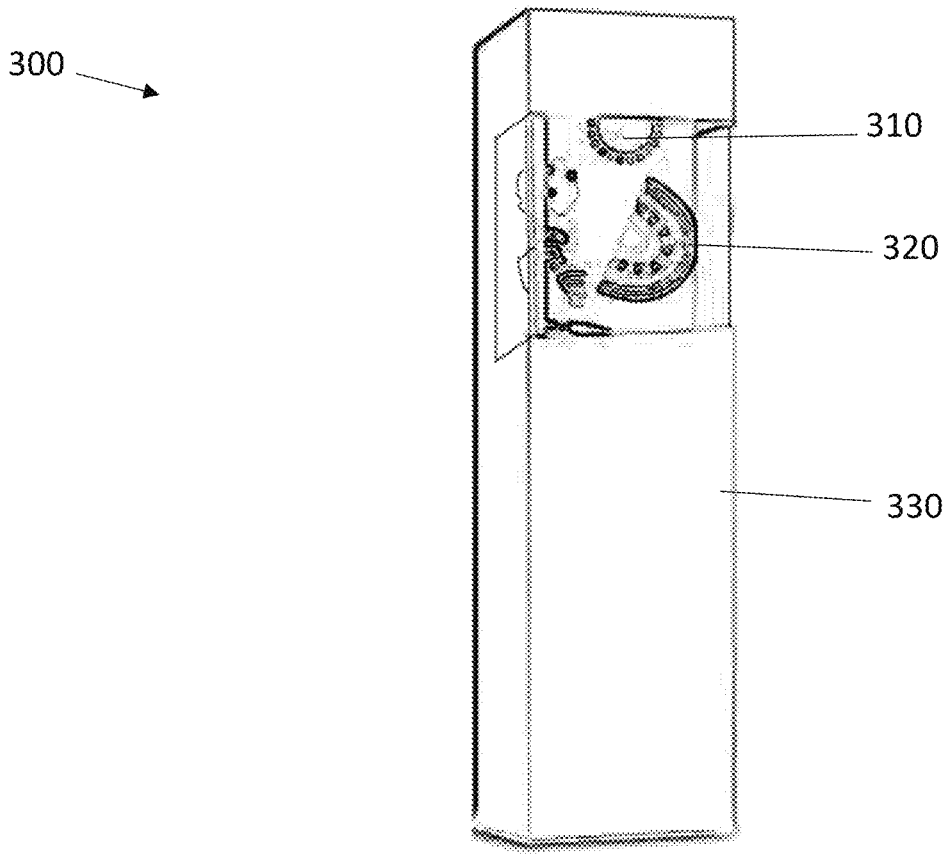
FIG. 8 is a perspective view of on example of a packaged safety mat.

FIG. 8 is a kit 300 including a first safety mat 320 having a base layer with a lower surface and an upper surface an adhesive layer disposed on the lower surface of the base layer. The first safety mat includes a release liner attached to the adhesive layer, the release liner configured for removal to expose the adhesive layer for adhering the safety mat to a surface a graphics layer disposed on the upper surface of the base layer. In the kit 300 a second safety mat 310 has a base layer with a lower surface and an upper surface, and a graphics layer disposed on the upper surface of the base layer, the graphics layer having a design that matches the design of the first safety mat. The first safety mat 320 and the second safety mat 310 are non-slip and mold-resistant. The graphics layer of the first safety mat 320 and the second safety 310 mat may include customizable designs. The kit may include any combination of safety mats and any number of safety mats. For example, a larger household may desire a kit including graphic layers for multiple rooms layouts. Another example would be the kit including various combinations of safety mat sizes and number of mats, depending on room function. The safety mat may additionally be sizable whereby portions of the safety mat may be removable to accommodate odd spaces or particularly small areas. The safety mat may additionally include attachment fasteners along at least one edge of the safety mat for attachment to other safety mats for covering large areas.

In one embodiment, the adhesive layer of the first safety mat and the second safety mat may be configured to allow the safety mat to be rolled into a temporary rolled position before installation.

In one embodiment, the graphics layer may include a design a second adhesive layer disposed between the base layer and the graphics layer, the second adhesive layer configured to allow the graphics layer to be changeable.

In one embodiment, using FIG. 1 as an example, the safety mat is photoluminescent, providing additional safety in areas like bathrooms, kitchens, hospitals, etc. The safety mat may be used on stairs, elevator floors, malls, arenas or along with the other high-traffic areas. The base layer 130 may include a photoluminescent material 131 integrated with the base layer 130 or applied to the base layer after manufacture of the base layer. The graphic layer 110 is then place on top of the base layer 130 where at least a portion of the base layer would be visible outside of the graphics area, within the graphics area between graphic features, or through the graphics area if the graphics are transparent of semi-transparent. Alternately, the graphics layer may be photoluminescent and may be additionally enclosed in the kit, either as a permanent graphic or a changeable graphic.

The instant invention 100 can also be comprised of two top layers 110 and 130 where the first top layer 110 has graphics printed so the graphics face up and are distal from the floor and a second top layer 130 that is a working top layer that is attached to the adhesive layer 140 proximal to the floor. The release liner 150 is attached to the adhesive layer 140. The first top layer can have a second adhesive layer 120 that allows the user to attach it to the second top layer 130. This creates a mat that can have changeable top layers. The incorporation of a changeable top layer with graphics makes it easy for the user of the mat to change the graphics so they can accommodate either functional requirements or interior design requirements. For example, the top layer could have graphics of colored fruit for a child who is 2-3 years old, and it could be changed to the alphabet for the same child when they are 4-5 years old.

When the instant invention is configured with two top layers the mat and at least two top layers can be incorporated into a kit. This allows the user to purchase 1 mat and use it with at least two graphics. The kit includes a mat having an adhesive layer and at least two graphic layers which may have their own adhesive layer. Alternately, mechanical fasteners may be used to allow removal or change of the graphics layer.

The kit may include bundles such as a bathtub or shower mat, toilet mat, mat for the stepping area outside of the shower or bathtub, toilet lid, and self-adhesive rolls for the washstand or top surface of the bathtub rim. For stairs, a kit includes pad options which may incudes safety mats for any of the stair treads, landing tread, risers, handrails, etc., or any combination thereof.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

In addition, the present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized that the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A non-slip safety mat, comprising:

a base layer having a lower surface and an upper surface;

a first adhesive layer disposed on the lower surface of the base layer;

a release liner attached to the first adhesive layer, the release liner configured for removal to expose the first adhesive layer for adhering the safety mat to a surface;

a removable graphics layer disposed on the upper surface of the base layer having a glass bead surface, the graphics layer further having a design and the design is textured so as to prevent a user from slipping; and a second adhesive layer disposed between the base layer and the graphics layer, the second adhesive layer configured to allow the graphics layer to be changeable.

2. The non-slip safety mat of claim 1, wherein the base layer is made from the group consisting of rubber and foam.

3. The non-slip safety mat of claim 1, wherein the texture of the base layer includes dimples or a sand texture.

4. The non-slip safety mat of claim 1, wherein the second adhesive layer is a temporary adhesive layer disposed between the base layer and the graphics layer, the temporary adhesive layer configured to allow the graphics layer to be changeable.

5. The non-slip safety mat of claim 1, wherein the safety mat is part of a kit including a first safety mat for use in a shower stall, bathtub or bathroom floor and a matching second mat for a second area.

6. The non-slip safety mat of claim 5, wherein at least a portion of the safety mat is photoluminescent.

7. The non-slip safety mat of claim 1, wherein the safety mat is non-slip and mold-resistant.

8. A non-slip safety mat, comprising:

a base layer having a lower surface and an upper surface;

a first adhesive layer disposed on the lower surface of the base layer;

a release liner attached to the first adhesive layer, the release liner configured for removal to expose the first adhesive layer for adhering the safety mat to a surface;

a removable graphics layer disposed on the upper surface of the base layer having a glass bead surface, the graphics layer having a design;

a second adhesive layer disposed between the base layer and the graphics layer, the second adhesive layer configured to allow the graphics layer to be changeable; and a texture disposed on the base layer, the texture comprising a glass bead surface configured to prevent a user from slipping on the safety mat.

9. The non-slip safety mat of claim 8, wherein the graphics layer includes customizable designs.

10. The non-slip safety mat of claim 8, wherein the adhesive layer is configured to allow the safety mat to be rolled into a temporary rolled position before installation.

11. The non-slip safety mat of claim 8, wherein the graphics layer is changeable to accommodate functional requirements or interior design requirements.

12. The non-slip safety mat of claim 11, wherein the graphics layer is changeable to display logos for room accommodations or hotels.

13. The non-slip safety mat of claim 11, wherein the texture of the base layer includes dimples or a sand texture.

14. The non-slip safety mat of claim 11, wherein at least a portion of the safety mat is photoluminescent.

15. The non-slip safety mat of claim 11, wherein the safety mat is part of a kit including a first safety mat for use in a shower stall, bathtub or bathroom floor, a graphics layer for the first safety mat and a matching second mat for a second area and a graphics layer for the second safety mat.

16. The non-slip safety mat of claim 15, wherein the matching second mat may have an adhesive layer or may be provided without the adhesive layer.

17. A kit for a non-slip safety mat, comprising:

a first non-slip safety mat having a base layer with a lower surface and an upper surface;

an adhesive layer disposed on the lower surface of the base layer;

a release liner attached to the adhesive layer, the release liner configured for removal to expose the adhesive layer for adhering the safety mat to a surface;

a removable graphics layer disposed on the upper surface of the base layer having a glass bead surface, the graphics layer further having a design and the design is textured so as to prevent a user from slipping;

a second adhesive layer disposed between the base layer and the graphics layer, the second adhesive layer configured to allow the graphics layer to be changeable; and a second non-slip safety mat having a base layer with a lower surface and an upper surface, and a graphics layer disposed on the upper surface of the base layer, the graphics layer having a design that matches the design of the first safety mat.

18. The kit of claim 17, wherein the first non-slip safety mat and the second safety mat are non-slip and mold-resistant.

19. The kit of claim 17, wherein the graphics layer of the first non-slip safety mat and the second non-slip safety mat includes customizable designs.

20. The kit of claim 17, wherein at least one of the first non-slip safety mat and second non-slip safety mat is photoluminescent.

* * * * *